US010283033B2

(12) United States Patent
Liu et al.

(10) Patent No.: US 10,283,033 B2
(45) Date of Patent: May 7, 2019

(54) DRIVING METHOD FOR DISPLAY PANEL, DRIVING CIRCUIT AND DISPLAY DEVICE

(71) Applicant: BOE TECHNOLOGY GROUP CO., LTD., Beijing (CN)

(72) Inventors: Ming Liu, Beijing (CN); Lintao Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 413 days.

(21) Appl. No.: 15/159,141

(22) Filed: May 19, 2016

(65) Prior Publication Data

US 2017/0092176 A1 Mar. 30, 2017

(30) Foreign Application Priority Data

Sep. 28, 2015 (CN) ..... 2015 1 0628932

(51) Int. Cl.
*G09G 3/34* (2006.01)
*G09G 3/20* (2006.01)

(52) U.S. Cl.
CPC ..... *G09G 3/2003* (2013.01); *G09G 3/20* (2013.01); *G09G 2320/0626* (2013.01); *G09G 2320/0686* (2013.01); *G09G 2330/021* (2013.01); *G09G 2360/16* (2013.01)

(58) Field of Classification Search
CPC ..... G09G 2320/0686
See application file for complete search history.

(56) References Cited

U.S. PATENT DOCUMENTS

2013/0314454 A1* 11/2013 Jin ..... G09G 3/3406 345/690
2015/0255016 A1* 9/2015 An ..... G09G 3/3233 345/211
2017/0092176 A1* 3/2017 Liu ..... G09G 3/2003

* cited by examiner

*Primary Examiner* — Carl Adams
(74) *Attorney, Agent, or Firm* — Nath, Goldberg & Meyer; Joshua B. Goldberg; Daniel Bissing

(57) ABSTRACT

A driving method for a display panel, a driving circuit and a display device are disclosed. The driving method comprises; dividing input signals into M×N final signal groups according to positions of respective corresponding initial pixels in an input image; determining a reference brightness value of each final subarea according to the input signals; determining a brightness reduction function corresponding to the reference brightness value of the final subarea; adjusting a brightness value of each initial pixel in the final subarea according to the brightness reduction function corresponding to the final subarea, so as to adjust the brightness value of each initial pixel in each final subarea from an initial brightness value to a final brightness value; generating a voltage enabling display pixels of the display panel to display the obtained final brightness values; and inputting the obtained voltage to the display pixels of the display panel, respectively.

16 Claims, 5 Drawing Sheets

DRIVING METHOD FOR DISPLAY PANEL, DRIVING CIRCUIT AND DISPLAY DEVICE

CROSS-REFERENCE TO RELATED APPLICATION

This application claims priority to Chinese Patent Application No. 201510628932.5, filed on Sep. 28, 2015, the contents of which are incorporated by reference in the entirety.

FIELD OF THE INVENTION

The present invention relates to the field of display technology, and specifically relates to a driving method for a display panel, a driving circuit for executing the driving method and a display device including the driving circuit.

BACKGROUND OF THE INVENTION

When a display panel is driven to display, a driving circuit is generally controlled by an auto current limit (ACL, Auto Current Limit) method in order to reduce the driving current.

Specifically, the working principle of the ACL method is as follows: calculating the brightness of each pixel in a frame of picture, finding a brightness reference point in the frame of picture, searching an ACL table by using the brightness of the brightness reference point to obtain a brightness reduction function, and adjusting the brightness of all the pixels in the frame of picture by using the brightness reduction function to reduce the brightness of all the pixels in the frame of picture, thus reducing the driving current.

However, this method is only suitable for a picture with a single gray scale and a picture with gray scales being almost the same therein. As to a picture with a relatively large brightness difference between different portions thereof, the ACL method may reduce the display effect of the picture.

Thus, how to reduce the driving current while ensuring the display effect of pictures has become a technical problem to be solved urgently in the art.

SUMMARY OF THE INVENTION

The object of the present disclosure is to provide a driving method for a display panel, a driving circuit for executing the driving method and a display device including the driving circuit, wherein the driving method can effectively reduce a driving current and also ensure the display effect of pictures.

The embodiments of the present invention provide a driving method for a display panel, including: step S1 of dividing multiple input signals into M×N final signal groups according to positions of respective corresponding initial pixels in an input image, wherein M and N are both positive integers, at least one of M and N is more than 1, each input signal corresponds to one initial pixel, the initial pixels corresponding to all the input signals constitute the input image, and each final signal group corresponds to one final subarea of the input image; step S2 of determining a reference brightness value of each final subarea according to the input signals; step S3 of determining a brightness reduction function corresponding to the reference brightness value of each final subarea; step S4 of adjusting a brightness value of each initial pixel in each final subarea according to the brightness reduction function corresponding to the final subarea, so as to adjust the brightness value of each initial pixel in each final subarea from an initial brightness value to a final brightness value; step S5 of generating a voltage enabling multiple display pixels corresponding to the initial pixels one by one in the display panel to display the final brightness values obtained in step S4; and step S6 of inputting the voltage obtained in step S5 to the display pixels of the display panel, respectively.

In step S3, the brightness reduction function corresponding to the reference brightness value of each final subarea can be determined by searching an auto current limit table.

In step S2, the reference brightness value of each final subarea in the input image may be an initial brightness value of the initial pixel with the maximum initial brightness value in the final subarea.

In step S1, all the input signals can be averagely divided into M×N groups according to the positions of initial pixels corresponding to the input signals in the input image, and each group of input signals is one final signal group.

Step S1 may include: step S1*a* of averagely dividing all input signals into M×N initial signal groups according to the positions of initial pixels corresponding to the input signals in an input image, wherein the M×N initial signal groups correspond to M×N initial subareas in the input image; step S1*b* of calculating average brightness of all initial pixels in each initial subarea according to the input signals in the corresponding initial signal group; and step S1*c* of calculating a difference between average brightness of two adjacent initial subareas; when the difference between average brightness of the two adjacent initial subareas is greater than a first preset value, setting an overlapping area in the two adjacent initial subareas, wherein one part of the overlapping area is positioned in one of the two adjacent initial subareas, while the other part of the overlapping area is positioned in the other of the two adjacent initial subareas, so that the final subareas include the initial subareas from which the overlapping area is subtracted; and when the difference between average brightness of the two adjacent initial subareas is not greater than the first preset value, setting the initial subareas as the final subareas.

In the presence of the overlapping area, step S2 further includes determining a reference brightness value of the overlapping area, step S3 further includes determining a brightness reduction function corresponding to the reference brightness value of the overlapping area, and step S4 further includes adjusting a brightness value of each initial pixel in the overlapping area according to the brightness reduction function corresponding to the overlapping area, so as to adjust the brightness value of each initial pixel in the overlapping area from an initial brightness value to a final brightness value.

Before step S1, the driving method may further include: step S01 of acquiring an initial brightness value of each initial pixel in the input image according to the input signals; and step S02 of calculating a difference between the initial brightness value of the initial pixel with the maximum initial brightness value and the initial brightness value of the initial pixel with the minimum initial brightness value in the input image, and when the difference between the initial brightness value of the initial pixel with the maximum initial brightness value and the initial brightness value of the initial pixel with the minimum initial brightness value in the input image is greater than a second preset value, executing step S1.

In step S02, when the difference between the initial brightness value of the initial pixel with the maximum initial brightness value and the initial brightness value of the initial pixel with the minimum initial brightness value in the input image is not greater than the second preset value, the driving method executes: step S7 of determining a reference brightness value of the input image; step S8 of determining a brightness reduction function corresponding to the reference brightness value of the input image; step S9 of adjusting a brightness value of each initial pixel in the input image according to the brightness reduction function, so as to adjust the brightness value of each initial pixel from an initial brightness value to a final brightness value; step S10 of generating a voltage enabling multiple display pixels corresponding to the initial pixels one by one in the display panel to display the final brightness values obtained in step S9; and step S11 of inputting the voltage obtained in step S10 to the display pixels of the display panel, respectively.

The embodiments of the present invention further provide a driving circuit for driving a display panel, including: a signal group dividing module, configured to divide multiple input signals into M×N final signal groups according to positions of respective corresponding initial pixels in an input image, wherein M and N are both positive integers, at least one of M and N is more than 1, each input signal corresponds to one initial pixel, the initial pixels corresponding to all the input signals constitute the input image, and each final signal group corresponds to one final subarea of the input image; a reference brightness determining module, configured to determine a reference brightness value of each final subarea according to the input signals; a function determining module, configured to determine a brightness reduction function corresponding to the reference brightness value of each final subarea; a brightness adjusting module, configured to adjust brightness of each initial pixel in each final subarea according to the brightness reduction function, and capable of adjusting a brightness value of each initial pixel in each final subarea from an initial brightness value to a final brightness value; a voltage generating module, configured to generate a voltage for controlling multiple display pixels corresponding to the initial pixels one by one in the display panel to display the final brightness values obtained by the brightness adjusting module; and a voltage output module, configured to input the voltage generated by the voltage generating module to the display pixels of the display panel, respectively.

The function determining module can determine the brightness reduction function corresponding to the reference brightness value of each final subarea by searching an auto current limit table.

The reference brightness value of each final subarea in the input image may be an initial brightness value of the initial pixel with the maximum initial brightness value in the final subarea.

The signal group dividing module can averagely divide all the input signals into M×N groups according to the positions of initial pixels corresponding to the input signals in the input image, and each group of input signals is one final signal group.

The signal group dividing module may include: an initial signal group dividing unit, configured to averagely divide all input signals into M×N initial signal groups according to the positions of initial pixels corresponding to the input signals in the input image, wherein the M×N initial signal groups correspond to M×N initial subareas in the input image; a brightness difference calculation unit, configured to calculate a difference between average brightness of two adjacent initial subareas; and an overlapping area setting unit, configured to, when the difference between average brightness of the two adjacent initial subareas is greater than a first preset value, set an overlapping area in the two adjacent initial subareas, wherein one part of the overlapping area is positioned in one of the two adjacent initial subareas, while the other part of the overlapping area is positioned in the other of the two adjacent initial subareas, so that the final subareas include the initial subareas from which the overlapping area is subtracted; and configured to, when the difference between average brightness of the two adjacent initial subareas is not greater than the first preset value, set the initial subareas as the final subareas.

In the presence of the overlapping area, the reference brightness determining module determines a reference brightness value of the overlapping area, the function determining module determines a brightness reduction function corresponding to the reference brightness value of the overlapping area, and the brightness adjusting module adjusts a brightness value of each initial pixel in the overlapping area according to the brightness reduction function corresponding to the overlapping area, so as to adjust the brightness value of each initial pixel in the overlapping area from an initial brightness value to a final brightness value.

The driving circuit may further include: a brightness value acquisition module, configured to acquire an initial brightness value of each initial pixel in the input image according to the input signals. The brightness difference calculation unit calculates a difference between the brightness value of the initial pixel with the maximum initial brightness value and the brightness value of the initial pixel with the minimum initial brightness value in the input image; when the difference between the brightness value of the initial pixel with the maximum initial brightness value and the brightness value of the initial pixel with the minimum initial brightness value in the input image is greater than a second preset value, the brightness difference calculation unit can send a starting signal to the initial signal group dividing unit, and the initial signal group dividing unit can divide the input signals into M×N initial signal groups after receiving the starting signal.

When the difference between the brightness value of the initial pixel with the maximum initial brightness value and the brightness value of the initial pixel with the minimum initial brightness value in the input image is not greater than the second preset value, the reference brightness determining module determines a reference brightness value of the input image according to the input signals, the function determining module determines a brightness reduction function corresponding to the reference brightness value of the input image, and the brightness adjusting module adjusts a brightness value of each initial pixel in the input image according to the brightness reduction function corresponding to the reference brightness value of the input image, so as to adjust the brightness value of each initial pixel from an initial brightness value to a final brightness value.

The driving circuit may further include: a storage module, which stores multiple reference brightness values and brightness reduction functions corresponding to the reference brightness values.

The embodiments of the present invention further provide a display device including a display panel and a driving circuit for driving the display panel, wherein the driving circuit is the above one provided by the present invention.

In the driving method provided by the present invention, after an input image is divided into M×N final subareas, the brightness difference between the pixels in each separate final subarea is smaller than that between the pixels in the overall input image. Steps S2 to S4 actually belong to an ACL method carried out for each final subarea, and the brightness reduction functions adopted for the final subareas may be different, so that the display effect of each final subarea is not greatly different from that of the original input image, and the display effect of the overall image is not greatly different from that of the original input image either. Moreover, the ACL method can also reduce a driving current and reduce energy consumption. In other words, the present invention reduces the total driving current while ensuring the display effect of the image.

BRIEF DESCRIPTION OF THE DRAWINGS

The accompanying drawings are used for providing further understanding of the present invention, constitute a part of the description, and are used for interpreting the present invention together with specific embodiments below, rather than limiting the present invention. In the drawings.

DESCRIPTION OF THE PREFERRED EMBODIMENT

The specific embodiments of the present invention will be described in detail below in combination with the accompanying drawings. It should be understood that the specific embodiments described herein are merely used for describing and interpreting the present invention, rather than limiting the present invention.

Figure 1:
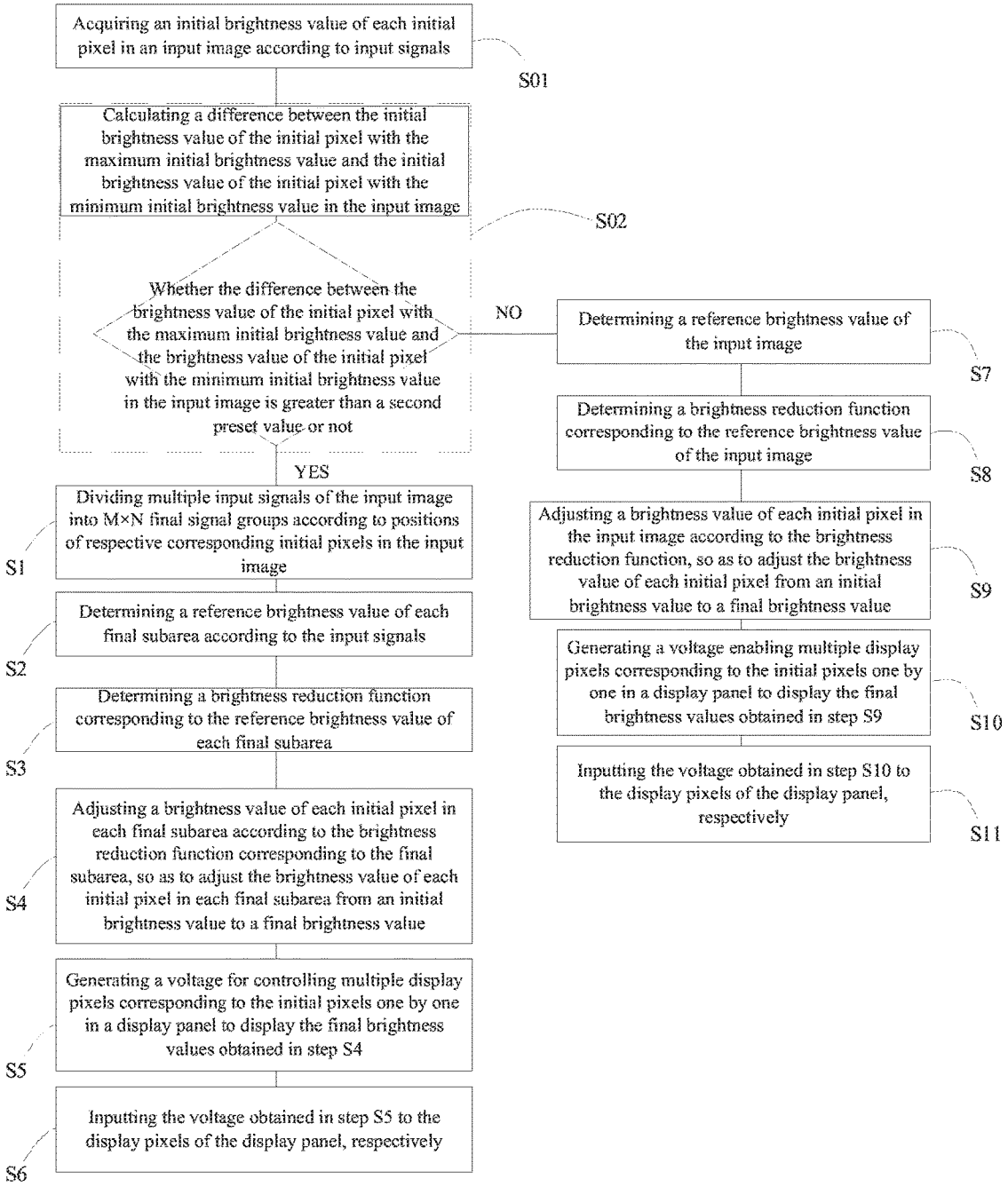
FIG. 1 is a flow diagram of a driving method according to an embodiment of the present invention.

As shown in FIG. 1, the embodiments of the present invention provide a driving method for a display panel, including steps S1 to S6 below.

Step S1 includes: dividing multiple input signals into M×N final signal groups according to the positions of respective corresponding initial pixels in an input image, wherein M and N are both positive integers, at least one of M and N is more than 1, each input signal corresponds to one initial pixel, the initial pixels corresponding to all the input signals constitute the input image, and each final signal group corresponds to one final subarea of the input image.

Step S2 includes: determining a reference brightness value of each final subarea according to the input signals.

Step S3 includes: determining a brightness reduction function corresponding to the reference brightness value of each final subarea.

Step S4 includes: adjusting the brightness value of each initial pixel in each final subarea according to the brightness reduction function, so as to adjust the brightness value of each initial pixel in each final subarea from an initial brightness value to a final brightness value.

Step S5 includes: generating a voltage enabling multiple display pixels corresponding to the initial pixels one by one in the display panel to display the final brightness values obtained in step S4.

Step S6 includes: inputting the voltage obtained in step S5 to the display pixels of the display panel, respectively.

When a display device is used for displaying, an input image is transmitted in the form of input signals. The input image includes multiple initial pixels, and each initial pixel corresponds to one input signal. Thus, dividing the input signals into M×N final signal groups is equivalent to dividing the input image into M×N final signal groups. In the driving method of the embodiment of the present invention, after the display image is divided into M×N final subareas, the brightness difference between the initial pixels in each separate final subarea is smaller than that between the initial pixels in the overall input image. In steps S2 to S4, actually an auto current limit (ACL) method is carried out for each final subarea, and the brightness reduction functions adopted for final subareas may be different, so that the display effect of each final subarea is not greatly different from that of the original input image, and the display effect of the overall image is not greatly different from that of the original input image either. Moreover, the ACL method can also reduce the voltage for driving the display panel, thus reduce the driving current and reduce energy consumption. In other words, the embodiment of the present invention reduces the total driving voltage while ensuring the display effect of the image.

It could be understood by those skilled in the art that the brightness reduction function herein is a gamma adjusting function, and display pixels refer to pixel units of the display panel.

Figure 2:
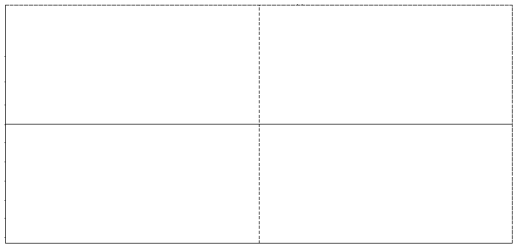
FIG. 2 is a schematic diagram of dividing an input image.

In step S1, at least one of M and N is more than 1, that is to say, the input signals are divided into at least two final signal groups, namely, the input image is divided into at least two final subareas. Of course, in the embodiments of the present invention, the specific values of M and N are not limited, the more the final signal groups divided from the input signals are, the more the final subareas divided from the input image are and the smaller the difference between the final displayed image and the input image is. Generally, the higher the resolution of the input image is (i.e., the more the input signals are), the larger the M and the N are. In the embodiment shown in FIG. 2, input image is divided into 2×2 final subareas. The expression that "at least one of M and N is more than 1" includes two situations, wherein in one situation, M and N are both more than 1, and in the other situation, one of M and N is 1, and the other one of M and N is more than 1.

In step S3, the brightness reduction function is obtained by searching an auto current limit table (i.e., an ACL table). For example, if the reference brightness value of a final subarea obtained in step S2 is Ga, the brightness reduction function $f(G_{ij})=G_{ij}-A$ corresponding to the reference brightness value Ga can be obtained from the ACL table in step S3, wherein A is a fixed positive number, $G_{ij}$ is the brightness value of the initial pixel at row i and at column j in the final subarea, and $f(G_{ij})$ is the brightness value of the initial pixel at row i and at column j in the final subarea after the brightness is reduced. Of course, the above formula for the function is merely used for interpreting what is the brightness reduction function, rather than limiting the brightness reduction function.

Figure 3:
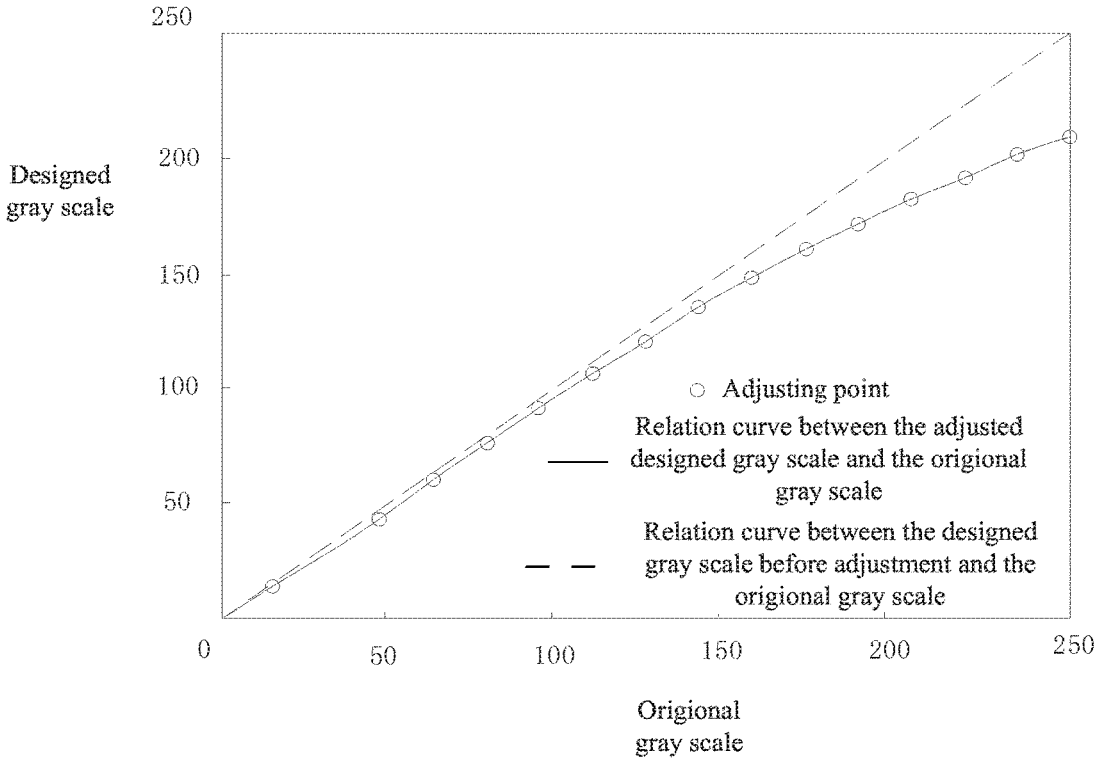
FIG. 3 is a schematic diagram of an ACL table.

FIG. 3 shows a schematic diagram of an ACL table. It could be understood by those skilled in the art that the gray scale corresponds to the brightness. Thus, in FIG. 3, the brightness of each initial pixel of the input image corresponds to the "original gray scale", and the designed gray scale refers to the gray scale of a display pixel corresponding to the initial pixel in the display panel when the display panel performs display and also corresponds to the "final brightness value" in the embodiment of the present invention. In the absence of ACL control, as shown by the dotted line in FIG. 3, the original gray scale is the same as the designed gray scale. After ACL control, the designed gray scale is lower than the original gray scale.

In the embodiment of the present invention, the "reference brightness" in step S2 is not specially limited. For example, the reference brightness may be the average brightness of initial pixels in each final subarea, or the brightness of the initial pixel with maximum brightness in multiple initial pixels of each final subarea.

In some embodiments of the present invention, the reference brightness value of each final subarea in the input image is the brightness value of the initial pixel with maximum brightness in the final subarea in step S2.

In the embodiments of the present invention, the method for dividing the final subareas is not specially limited. For example, in step S1, all the input signals can be averagely divided into M×N groups according to the positions of initial pixels corresponding to the input signals in the input image, and each group of input signals is one final signal group. The quantity of input signals in each of M×N final signal groups is equal, so the size of each of M×N final subareas is equal. This method is simple in calculation, and can improve the calculation speed.

Figure 4:
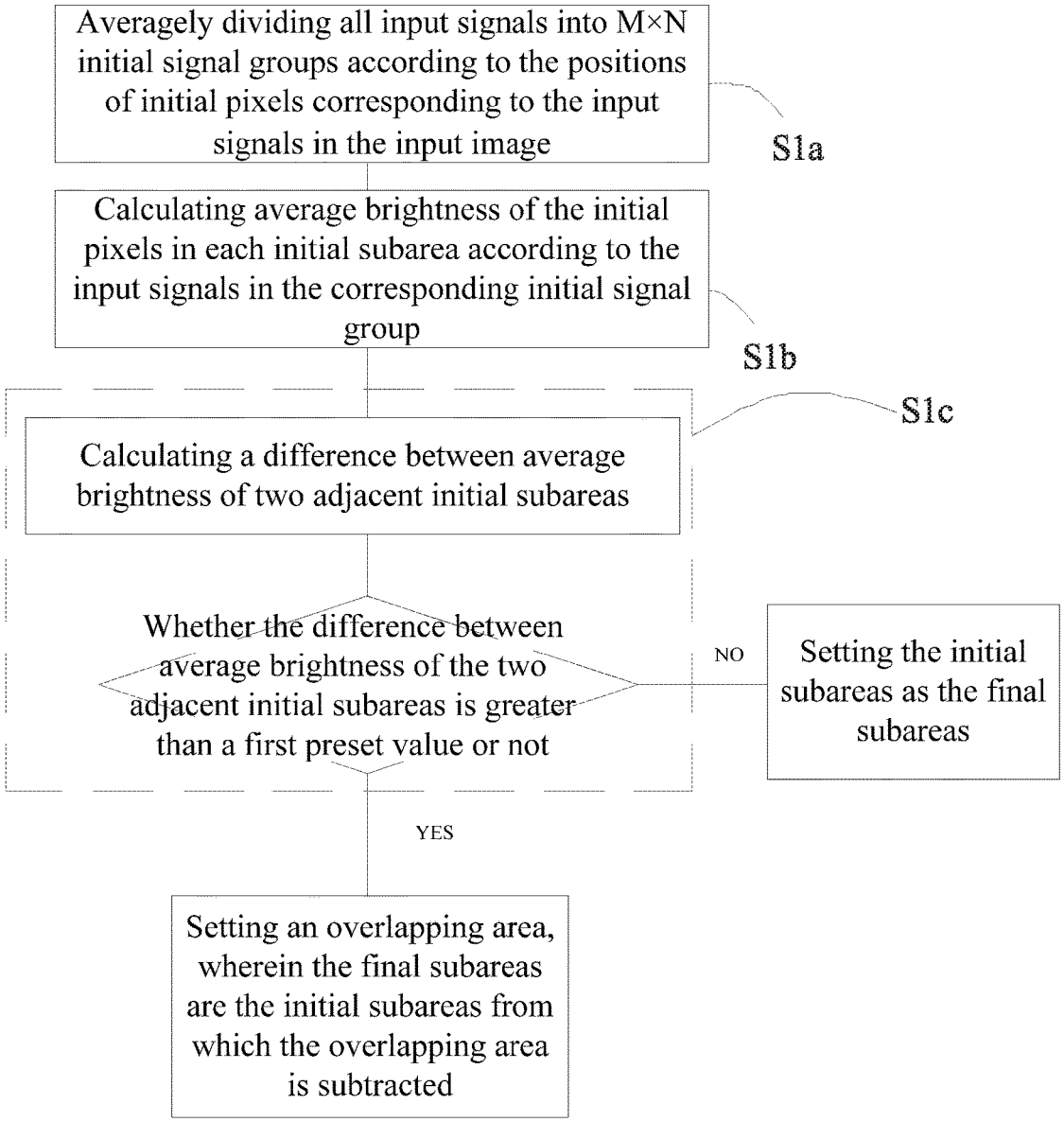
FIG. 4 is a flow diagram of step S1 in the driving method of FIG. 1.

As shown in FIG. 4, step S1 includes following steps S1*a* to S1*c* in some embodiments in order to further improve the display effect of pictures.

Step S1*a* includes: averagely dividing all input signals into M×N initial signal groups according to the positions of initial pixels corresponding to the input signals in an input image, wherein the M×N initial signal groups correspond to M×N initial subareas in the input image.

Step S1*b* includes: calculating the average brightness of all initial pixels in the corresponding initial subarea according to the input signals in each initial signal group.

Step S1*c* includes: calculating a difference between average brightness of two adjacent initial subareas, and when the difference between average brightness of the two adjacent initial subareas is greater than a first preset value, setting an overlapping area in the two adjacent initial subareas, wherein one part of the overlapping area is positioned in one of the two adjacent initial subareas, while the other part of the overlapping area is positioned in the other of the two adjacent initial subareas, so that the final subareas include the initial subareas from which the overlapping area is subtracted; and when the difference between average brightness of the two adjacent initial subareas is not greater than the first preset value, setting the initial subareas as the final subareas.

In the presence of the overlapping area, step S2 further includes determining a reference brightness value of the overlapping area, step S3 further includes determining a brightness reduction function corresponding to the reference brightness value of the overlapping area, and step S4 further includes adjusting the brightness value of each initial pixel in the overlapping area according to the brightness reduction function corresponding to the overlapping area, so as to adjust the brightness value of each initial pixel in the overlapping area from an initial brightness value to a final brightness value.

After the overlapping area is set, the brightness value of each initial pixel in the overlapping area is adjusted according to the brightness reduction function corresponding to the reference brightness value of the overlapping area, so that the display brightness of each initial pixel in the overlapping area can be closer to the brightness of the area in the input image, and obvious boundaries caused by an excessively large brightness difference between different final subareas can be avoided.

In order to simplify the driving method, the driving method further includes steps S01 and S02 before step S1 in some embodiments.

Step S01 includes: acquiring the initial brightness value of each initial pixel in the input image according to the input signals.

Step S02 includes: calculating a difference between the initial brightness value of the initial pixel with the maximum initial brightness value and the initial brightness value of the initial pixel with the minimum initial brightness value in the input image, and when the difference between the initial brightness value of the initial pixel with the maximum initial brightness value and the initial brightness value of the initial pixel with the minimum initial brightness value in the input image is greater than a second preset value, executing step S1.

Whether the input image involves a picture with a relatively large brightness difference between different portions thereof or not can be judged through step S02. When the difference between the initial brightness value of the initial pixel with the maximum initial brightness value and the initial brightness value of the initial pixel with the minimum initial brightness value in the input image is greater than the second preset value, it indicates that the input image involves a picture with a relatively large brightness difference between different portions thereof. After the input image being a picture with a relatively large brightness difference between different portions thereof is determined, the final brightness value of each subarea can be calculated according to a subarea ACL method, so that the driving current can be reduced and also the display effect of pictures can be ensured.

In step S02, when the difference between the brightness value of the initial pixel with the maximum initial brightness value and the brightness value of the initial pixel with the minimum initial brightness value in the input image is not greater than the second preset value, the following step S7 to step S11 are executed.

Step S7 includes: determining a reference brightness value of the input image.

Step S8 includes: determining a brightness reduction function corresponding to the reference brightness value of the input image.

Step S9 includes: adjusting the brightness value of each initial pixel in the input image according to the brightness reduction function, so as to adjust the brightness value of each initial pixel from an initial brightness value to a final brightness value.

Step S10 includes: generating a voltage enabling multiple display pixels corresponding to the initial pixels one by one in the display panel to display the final brightness values obtained in step S9.

Step S11 includes: inputting the voltage obtained in step S10 to the display pixels of the display panel, respectively.

Steps S7 to S10 are also an ACL driving method. The input image is not divided in these steps, so that the calculation speed of the driving method in the embodiment of the present invention can be improved.

That is to say, the driving method in the embodiment of the present invention can be used for displaying a picture with a relatively large brightness difference between different portions thereof and also a picture with a single gray scale or a picture with gray scales being almost the same therein.

Figure 5:
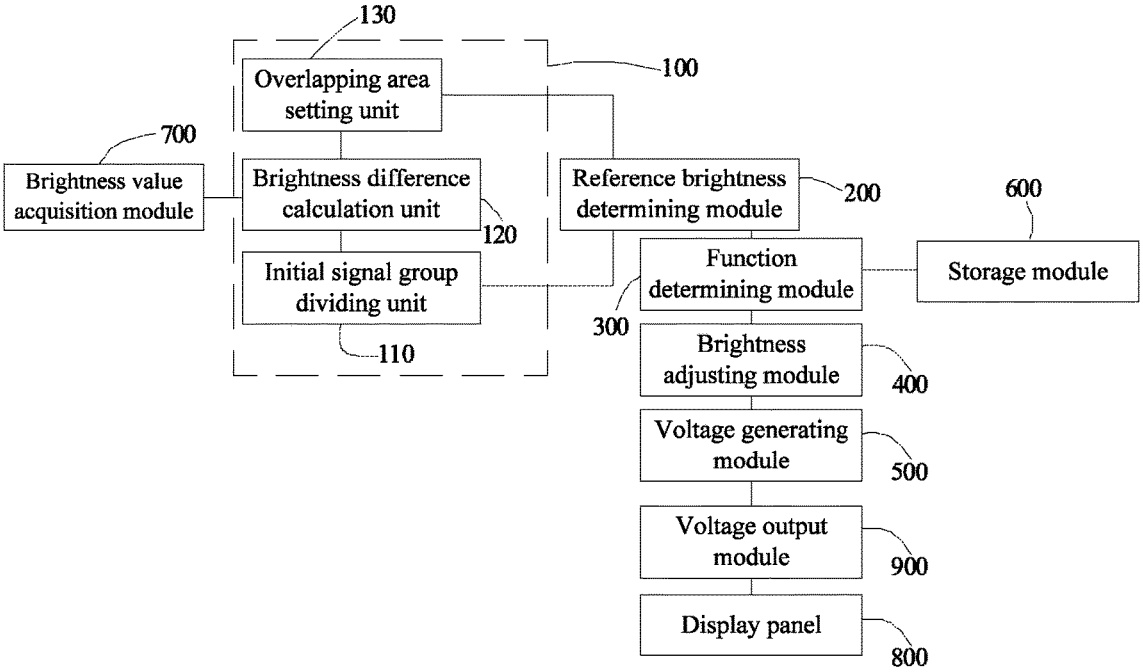
FIG. 5 is a schematic diagram showing modules of a driving circuit according to an embodiment of the present invention, which are connected to a display panel.

The embodiments of the present invention further provide a driving circuit for executing the above driving method, wherein the driving circuit is used for driving a display panel. As shown in FIG. 5, the driving circuit includes a signal group dividing module 100, a reference brightness determining module 200, a function determining module 300, a brightness adjusting module 400, a voltage generating module 500 and a voltage output module 900.

The signal group dividing module 100 is configured to divide multiple input signals into M×N final signal groups according to the positions of respective corresponding initial pixels in an input image, wherein M and N are both positive integers, at least one of M and N is more than 1, each input signal corresponds to one initial pixel, the initial pixels corresponding to all the input signals constitute the input image, and each final signal group corresponds to one final subarea of the input image.

The reference brightness determining module 200 is configured to determine a reference brightness value of each final subarea according to the input signals.

The function determining module 300 is configured to determine a brightness reduction function corresponding to the reference brightness value of each final subarea.

The brightness adjusting module 400 is configured to adjust the brightness of each initial pixel according to the brightness reduction function, and adjust the brightness value of each initial pixel in each final subarea from an initial brightness value to a final brightness value.

The voltage generating module 500 is configured to generate a voltage for controlling multiple display pixels corresponding to the initial pixels one by one in the display panel to display the final brightness values obtained by the brightness adjusting module 400.

The voltage output module 900 is configured to input the voltage generated by the voltage generating module 500 to the display pixels of the display panel 800, respectively.

In the driving circuit of the embodiment of the present invention, the signal group dividing module 100 is configured to execute step S1 in the above driving method, the reference brightness determining module 200 is configured to execute step S2 in the driving method, the function determining module 300 is configured to execute step S3 in the driving method, the brightness adjusting module 400 is configured to execute step S4 in the driving method, and the voltage generating module 500 is configured to execute step S5 in the driving method.

After the input signals are divided into M×N final signal groups by the signal group dividing module 100, an ACL method is carried out for each final subarea by using the function determining module 300, the brightness adjusting module 400 and the voltage generating module 500. The brightness difference between the initial pixels in each separate final subarea is smaller than that between the initial pixels in the overall input image, and the brightness reduction functions adopted for the final subareas may be different, so that the display effect of each final subarea is not greatly different from that of the original input image, and the display effect of the overall image is not greatly different from that of the original input image either. Moreover, the ACL method can reduce the driving current and reduce energy consumption.

The ACL method is already described in detail above, and will not be redundantly described herein.

In some embodiments of the present invention, the reference brightness value of each final subarea in the input image is the brightness value of the pixel with maximum brightness in the final subarea.

In the embodiments of the present invention, the specific structure of the signal group dividing module has no specific requirement, as long as it can execute step S1 to divide the input signals into M×N final signal groups. For example, when the input signals are averagely divided into M×N groups according to the positions of initial pixels corresponding to the input signals in the input image and each group of input signals is one final signal group, the signal group dividing module 100 can averagely divide the input signals into M×N groups according to the positions thereof in the input image, and each group of input signals is one final signal group.

In some embodiments, the signal group dividing module 100 may include an initial signal group dividing unit 110, a brightness difference calculation unit 120 and an overlapping area setting unit 130 in order to improve display effects of pictures.

The initial signal group dividing unit 110 is configured to execute step S1*a* in the above driving method, namely configured to averagely divide all input signals into M×N initial signal groups according to the positions of initial pixels corresponding to the input signals in the input image, wherein the M×N initial signal groups correspond to M×N initial subareas in the input image.

The brightness difference calculation unit 120 is configured to execute step S1*b* in the driving method, namely configured to calculate the difference between average brightness of two adjacent initial subareas.

The overlapping area setting unit 130 is configured to execute step S1*c* in the driving method, namely configured to, when the difference between average brightness of the two adjacent initial subareas is greater than a first preset value, set an overlapping area in the two adjacent initial subareas, wherein one part of the overlapping area is positioned in one of the two adjacent initial subareas, while the other part of the overlapping area is positioned in the other of the two adjacent initial subareas, so that the final subareas include the initial subareas from which the overlapping area is subtracted; and when the difference between average brightness of the two adjacent initial subareas is not greater than the first preset value, set the initial subareas as the final subareas.

In the presence of the overlapping area, the reference brightness determining module 200 is further configured to determine a reference brightness value of the overlapping area, the function determining module 300 is further configured to determine a brightness reduction function corresponding to the reference brightness value of the overlapping area, and the brightness adjusting module 400 is further configured to adjust the brightness value of each initial pixel in the overlapping area according to the brightness reduction function corresponding to the overlapping area, so as to adjust the brightness value of each initial pixel in the overlapping area from an initial brightness value to a final brightness value.

In order to facilitate calculation, the ACL table can be stored in the driving circuit, and the ACL table includes multiple reference brightness values and brightness reduction functions corresponding to the brightness values. Specifically, the driving circuit may further include a storage module 600, which stores multiple reference brightness values and brightness reduction functions corresponding to the reference brightness values.

In some embodiments, the driving circuit may further include a brightness value acquisition module 700, which is configured to acquire the initial brightness value of each initial pixel in the input image according to the input signals.

The brightness difference calculation unit 120 is further configured to calculate a difference between the brightness value of the initial pixel with the maximum initial brightness value and the brightness value of the initial pixel with the minimum initial brightness value in the input image; when the difference between the brightness value of the initial pixel with the maximum initial brightness value and the brightness value of the initial pixel with the minimum initial brightness value in the input image is greater than a second preset value, the brightness difference calculation unit 120 sends a starting signal to the initial signal group dividing unit 110, and the initial signal group dividing unit 110 divides the input image into M×N initial subareas after receiving the starting signal.

The brightness value acquisition module 700 is configured to execute step S01 in the above driving method, and the brightness difference calculation unit 120 is further configured to execute step S02 in the above driving method.

The aim of providing the brightness value acquisition module 700 and using the brightness difference calculation unit 120 to calculate the difference between the brightness value of the initial pixel with the maximum initial brightness value and the brightness value of the initial pixel with the minimum initial brightness value in the input image is to judge whether the input image is an image with an over large gray-scale difference or not. Only when receiving the starting signal, the initial signal group dividing unit 110 divides the input image into M×N initial subareas. It could be easily understood that the brightness difference calculation unit 120 herein not only has a brightness difference calculation function, but also has a comparison function.

When the difference between the brightness value of the initial pixel with the maximum initial brightness value and the brightness value of the initial pixel with the minimum initial brightness value in the input image is not greater than the second preset value, the reference brightness determining module 200 determines a reference brightness value of the input image according to the input signals. The function determining module 300 determines a brightness reduction function corresponding to the reference brightness value of the input image. The brightness adjusting module 400 adjusts the brightness value of each initial pixel in the input image according to the brightness reduction function corresponding to the reference brightness value of the input image, so as to adjust the brightness value of each initial pixel from an initial brightness value to a final brightness value. That is to say, the reference brightness determining module 200 is further configured to execute step S7, the function determining module 300 is further configured to execute step S8, the brightness adjusting module 400 is further configured to execute step S9, and the voltage generating module 500 is further configured to execute step S10.

The embodiments of the present invention further provide a display device including a display panel 800 and a driving circuit for driving the display panel 800, wherein the driving circuit is the above one provided by the embodiments of the present invention.

The display device including the driving circuit not only has low energy consumption, but also can ensure that pictures displayed by the display panel have good display effects.

Figure 6:
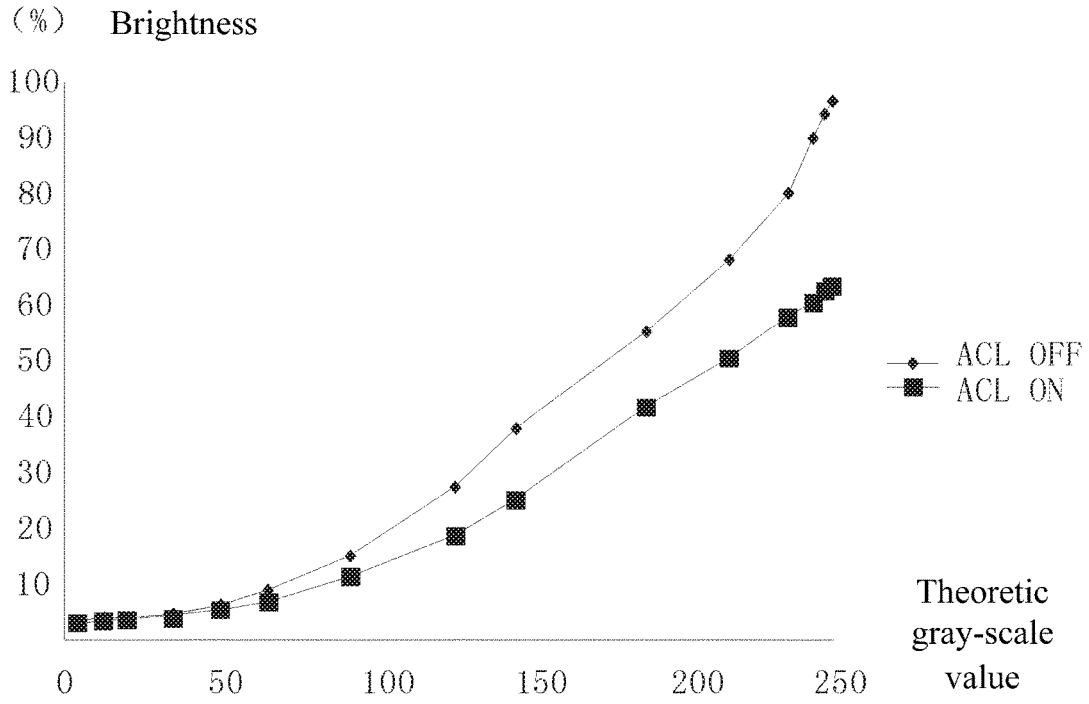
FIG. 6 is a comparison diagram of energy consumption needed when the display panel is driven by the driving method according to the embodiment of the present invention and when the display panel is directly driven.

FIG. 6 shows comparison between energy consumption needed when the display panel is driven by the driving method in the embodiment of the present invention and when the display panel is directly driven. So called directly driving the display panel means that the brightness of pixels is not adjusted and the display panel is directly driven according to the brightness of each pixel in the input image. It could be seen from the figure that, when the display panel is driven by the driving method in the embodiment of the present invention, the larger the gray-scale value is, the larger the reduction amount of the brightness is, thus the smaller the current required to drive the display panel is, and the lower the energy consumption is.

It could be understood that the above embodiments are merely exemplary embodiments adopted for describing the principle of the present invention, but the present invention is not limited thereto. Various variations and improvements may be made for those of ordinary skill in the art without departing from the spirit and essence of the present invention, and these variations and improvements shall also fall into the protection scope of the present invention.

The invention claimed is:

1. A driving method for a display panel, comprising:

step S1 of dividing multiple input signals into M×N final signal groups according to positions of respective corresponding initial pixels in an input image, wherein M and N are both positive integers, at least one of M and N is more than 1, each input signal corresponds to one initial pixel, the initial pixels corresponding to all the input signals constitute the input image, and each final signal group corresponds to one final subarea of the input image;

step S2 of determining a reference brightness value of each final subarea according to the input signals;

step S3 of determining a brightness reduction function corresponding to the reference brightness value of each final subarea;

step S4 of adjusting a brightness value of each initial pixel in each final subarea according to the brightness reduction function corresponding to the final subarea, so as to adjust the brightness value of each initial pixel in each final subarea from an initial brightness value to a final brightness value;

step S5 of generating a voltage enabling multiple display pixels corresponding to the initial pixels one by one in the display panel to display the final brightness values obtained in step S4; and step S6 of inputting the voltage obtained in step S5 to the display pixels of the display panel, respectively, wherein step S1 comprises:

step S1*a* of averagely dividing all input signals into M×N initial signal groups according to the positions of initial pixels corresponding to the input signals in an input image, wherein the M×N initial signal groups correspond to M×N initial subareas in the input image;

step S1*b* of calculating average brightness of all initial pixels in each initial subarea according to the input signals in the corresponding initial signal group; and step S1*c* of calculating a difference between average brightness of two adjacent initial subareas; when the difference between average brightness of the two adjacent initial subareas is greater than a first preset value, setting an overlapping area in the two adjacent initial subareas, wherein one part of the overlapping area is positioned in one of the two adjacent initial subareas, while an other part of the overlapping area is positioned in the other of the two adjacent initial subareas, so that the final subareas comprise the initial subareas from which the overlapping area is subtracted; and when the difference between average brightness of the two adjacent initial subareas is not greater than the first preset value, setting the initial subareas as the final subareas.

2. The driving method of claim 1, wherein in step S3, the brightness reduction function corresponding to the reference brightness value of each final subarea is determined by searching an auto current limit table.

3. The driving method of claim 1, wherein in step S2, the reference brightness value of each final subarea in the input image is an initial brightness value of the initial pixel with the maximum initial brightness value in the final subarea.

4. The driving method of claim 1, wherein in step S1, all the input signals are averagely divided into M×N groups according to the positions of initial pixels corresponding to the input signals in the input image, and each group of input signals is one final signal group.

5. The driving method of claim 1, wherein in the presence of the overlapping area, step S2 further comprises determining a reference brightness value of the overlapping area, step S3 further comprises determining a brightness reduction function corresponding to the reference brightness value of the overlapping area, and step S4 further comprises adjusting a brightness value of each initial pixel in the overlapping area according to the brightness reduction function corresponding to the overlapping area, so as to adjust the brightness value of each initial pixel in the overlapping area from an initial brightness value to a final brightness value.

6. The driving method of claim 1, wherein before step S1, the driving method further comprises:

step S01 of acquiring an initial brightness value of each initial pixel in the input image according to the input signals; and step S02 of calculating a difference between the initial brightness value of the initial pixel with the maximum initial brightness value and the initial brightness value of the initial pixel with the minimum initial brightness value in the input image, and when the difference between the initial brightness value of the initial pixel with the maximum initial brightness value and the initial brightness value of the initial pixel with the minimum initial brightness value in the input image is greater than a second preset value, executing step S1.

7. The driving method of claim 6, wherein in step S02, when the difference between the initial brightness value of the initial pixel with the maximum initial brightness value and the initial brightness value of the initial pixel with the minimum initial brightness value in the input image is not greater than the second preset value, the driving method executes:

step S7 of determining a reference brightness value of the input image;

step S8 of determining a brightness reduction function corresponding to the reference brightness value of the input image;

step S9 of adjusting a brightness value of each initial pixel in the input image according to the brightness reduction function, so as to adjust the brightness value of each initial pixel from an initial brightness value to a final brightness value;

step S10 of generating a voltage enabling multiple display pixels corresponding to the initial pixels one by one in the display panel to display the final brightness values obtained in step S9; and step S11 of inputting the voltage obtained in step S10 to the display pixels of the display panel, respectively.

8. A driving circuit for driving a display panel, comprising:

a signal group dividing module, configured to divide multiple input signals into M×N final signal groups according to positions of respective corresponding initial pixels in an input image, wherein M and N are both positive integers, at least one of M and N is more than 1, each input signal corresponds to one initial pixel, the initial pixels corresponding to all the input signals constitute the input image, and each final signal group corresponds to one final subarea of the input image;

a reference brightness determining module, configured to determine a reference brightness value of each final subarea according to the input signals;

a function determining module, configured to determine a brightness reduction function corresponding to the reference brightness value of each final subarea;

a brightness adjusting module, configured to adjust brightness of each initial pixel in each final subarea according to the brightness reduction function, and configured to adjust a brightness value of each initial pixel in each final subarea from an initial brightness value to a final brightness value;

a voltage generating module, configured to generate a voltage for controlling multiple display pixels corresponding to the initial pixels one by one in the display panel to display the final brightness values obtained by the brightness adjusting module; and a voltage output module, configured to input the voltage generated by the voltage generating module to the display pixels of the display panel, respectively, wherein the signal group dividing module comprises:

an initial signal group dividing unit, configured to averagely divide all input signals into M×N initial signal groups according to the positions of initial pixels corresponding to the input signals in the input image, wherein the M/N initial signal groups correspond to M/N initial subareas in the input image;

a brightness difference calculation unit, configured to calculate a difference between average brightness of two adjacent initial subareas; and an overlapping area setting unit, configured to, when the difference between average brightness of the two adjacent initial subareas is greater than a first preset value, set an overlapping area in the two adjacent initial subareas, wherein one part of the overlapping area is positioned in one of the two adjacent initial subareas, while an other part of the overlapping area is positioned in the other of the two adjacent initial subareas, so that the final subareas comprise the initial subareas from which the overlapping area is subtracted, and when the difference between average brightness of the two adjacent initial subareas is not greater than the first preset value, set the initial subareas as the final subareas.

9. The driving circuit of claim 8, wherein the function determining module determines the brightness reduction function corresponding to the reference brightness value of each final subarea by searching an auto current limit table.

10. The driving circuit of claim 8, wherein the reference brightness value of each final subarea in the input image is an initial brightness value of the initial pixel with the maximum initial brightness value in the final subarea.

11. The driving circuit of claim 8, wherein the signal group dividing module averagely divides all the input signals into M×N groups according to the positions of initial pixels corresponding to the input signals in the input image, and each group of input signals is one final signal group.

12. The driving circuit of claim 8, wherein in the presence of the overlapping area, the reference brightness determining module determines a reference brightness value of the overlapping area, the function determining module determines a brightness reduction function corresponding to the reference brightness value of the overlapping area, and the brightness adjusting module adjusts a brightness value of each initial pixel in the overlapping area according to the brightness reduction function corresponding to the overlapping area, so as to adjust the brightness value of each initial pixel in the overlapping area from an initial brightness value to a final brightness value.

13. The driving circuit of claim 8, further comprising a brightness value acquisition module, which is configured to acquire an initial brightness value of each initial pixel in the input image according to the input signals, wherein the brightness difference calculation unit calculates a difference between the brightness value of the initial pixel with the maximum initial brightness value and the brightness value of the initial pixel with the minimum initial brightness value in the input image; when the difference between the brightness value of the initial pixel with the maximum initial brightness value and the brightness value of the initial pixel with the minimum initial brightness value in the input image is greater than a second preset value, the brightness difference calculation unit sends a starting signal to the initial signal group dividing unit, and the initial signal group dividing unit divides the input signals into M×N initial signal groups after receiving the starting signal.

14. The driving circuit of claim 13, wherein when the difference between the brightness value of the initial pixel with the maximum initial brightness value and the brightness value of the initial pixel with the minimum initial brightness value in the input image is not greater than the second preset value, the reference brightness determining module determines a reference brightness value of the input image according to the input signals, the function determining module determines a brightness reduction function corresponding to the reference brightness value of the input image, and the brightness adjusting module adjusts a brightness value of each initial pixel in the input image according to the brightness reduction function corresponding to the reference brightness value of the input image, so as to adjust the brightness value of each initial pixel from an initial brightness value to a final brightness value.

15. The driving circuit of claim 8, further comprising a storage module, which stores multiple reference brightness values and brightness reduction functions corresponding to the reference brightness values.

16. A display device, comprising a display panel and the driving circuit of claim 8.

* * * * *